US007775386B2

(12) United States Patent
Falzoni

(10) Patent No.: US 7,775,386 B2
(45) Date of Patent: Aug. 17, 2010

(54) CLOSURE ELEMENT

(75) Inventor: Alessandro Falzoni, Imola (IT)

(73) Assignee: Sacmi Cooperativa Meccanici Imola Societa Cooperativa, Imola, BO (IT)

( * ) Notice: Subject to any disclaimer, the term of this patent is extended or adjusted under 35 U.S.C. 154(b) by 877 days.

(21) Appl. No.: 11/110,960

(22) Filed: Apr. 21, 2005

(65) Prior Publication Data

US 2006/0021959 A1 Feb. 2, 2006

(30) Foreign Application Priority Data

Jul. 30, 2004 (IT) ..... MO2004A0203

(51) Int. Cl.
*B65D 41/34* (2006.01)
*B65D 43/02* (2006.01)

(52) U.S. Cl. ..... 215/252; 215/44; 215/258; 215/343

(58) Field of Classification Search ..... 215/252, 215/254, 256, 258, 44, 343
See application file for complete search history.

(56) References Cited

U.S. PATENT DOCUMENTS 2,768,762 A * 10/1956 Guinet ..... 215/320
3,913,772 A 10/1975 Ochs et al.
4,386,712 A * 6/1983 DeWallace ..... 215/211
4,550,845 A 11/1985 Guala et al.
4,694,969 A 9/1987 Granat et al.
4,801,030 A * 1/1989 Barriac ..... 215/252
5,056,675 A 10/1991 Julian et al.
5,197,619 A 3/1993 Margaria
5,421,470 A * 6/1995 Dudzik ..... 215/350
5,450,973 A * 9/1995 Ellis et al. ..... 215/252
5,462,184 A * 10/1995 Ingram et al. ..... 215/252
5,660,288 A * 8/1997 Nyman, Jr. ..... 215/44
5,667,088 A 9/1997 King et al.
5,779,075 A * 7/1998 Salmon et al. ..... 215/252
5,875,909 A * 3/1999 Guglielmini ..... 215/350
6,126,025 A * 10/2000 Recendez M. ..... 215/252
6,202,871 B1 * 3/2001 Kelly ..... 215/307
6,308,848 B1 * 10/2001 Parrinello ..... 215/252
6,371,317 B1 * 4/2002 Krueger ..... 215/252

(Continued)

FOREIGN PATENT DOCUMENTS

EP 0 146 237 A 6/1985

(Continued)

*Primary Examiner*—Anthony Stashick
*Assistant Examiner*—Niki M Eloshway
(74) *Attorney, Agent, or Firm*—Nixon & Vanderhye P.C.

(57) ABSTRACT

A cap comprises an opening indicating element provided with a flap arrangement suitable for interacting with an abutment arrangement associated with a neck of a container, said flap arrangement comprising at least one first portion and at least one second portion arranged alongside one another along a peripheral edge of said opening indicating element, a dimension of said at least one second portion measured transversely in relation to said peripheral edge being greater than a corresponding dimension of said at least one first portion measured transversely in relation to said peripheral edge; a container comprises a neck from which an abutment arrangement projects and a cap provided with a flap arrangement suitable for interacting with said abutment arrangement, said abutment arrangement comprising a plurality of distinct abutment elements and said flap arrangement comprising at least one portion suitable for being received in a gap defined between two abutment elements of said plurality of abutment elements.

39 Claims, 16 Drawing Sheets

U.S. PATENT DOCUMENTS

| | | | | |
|---|---|---|---|---|
| 6,543,634 | B1 * | 4/2003 | Parrinello | 215/252 |
| 6,581,792 | B1 * | 6/2003 | Limanjaya | 215/252 |
| 6,581,793 | B1 * | 6/2003 | Racine et al. | 215/350 |
| 7,207,453 | B2 * | 4/2007 | Rossi | 215/344 |
| 2002/0162818 | A1 * | 11/2002 | Williams | 215/343 |
| 2003/0192854 | A1 * | 10/2003 | Gregory | 215/252 |
| 2005/0189312 | A1 * | 9/2005 | Bixler et al. | 215/252 |
| 2006/0021959 | A1 * | 2/2006 | Falzoni | 215/252 |
| 2006/0113272 | A1 * | 6/2006 | Rodriguez et al. | 215/252 |
| 2006/0169666 | A1 * | 8/2006 | Nyman et al. | 215/252 |

FOREIGN PATENT DOCUMENTS

| | | | |
|---|---|---|---|
| EP | 0 697 343 | | 2/1996 |
| EP | 0 854 095 | | 7/1998 |
| GB | 2 232 408 | A | 12/1990 |
| GB | 2 277 320 | A | 10/1994 |
| IT | 1232717 | | 3/1992 |
| JP | 10-167299 | | 6/1998 |
| JP | 2001-114313 | | 4/2001 |
| WO | WO 2005/012125 | | 2/2005 |
| WO | WO 2006/013443 | | 2/2006 |

* cited by examiner

CLOSURE ELEMENT

The invention relates to a closure element comprising abutment arrangement associated with a neck of a container and a cap provided with an opening indicating device provided with a safety ring and with a flap arrangement arranged to interact with the abutment arrangement. The invention furthermore relates to a seal member associable with a cap and being suitable for being interposed between the cap and a mouth of a neck of a container.

Caps are known consisting of a cylindrical skirt comprising a first portion, cooperating with a bottom wall to define a base body of the cap and a second portion that constitutes an opening indicating device suitable for informing the user of the wholeness of a product packaged in the container.

The second portion comprises a ring that interacts with a projection obtained in the neck of the container.

The projection is annular-shaped and projects from a side wall of the neck.

The first portion and second portion are separated by a nominal opening line consisting of a plurality of cuts, or openings passing through the cylindrical skirt and spaced by bridge elements that extend between the first portion and the second portion, which are intended to be fractured during the first opening of the container.

A plurality of flaps project from an edge zone of the ring that—in use—face the inside and face a top part of the cap.

At the moment of the first opening of the container, the flaps interact with the projection to prevent the detachment of the ring from the neck of the container and to promote the breakage of the bridge elements.

A drawback of the caps disclosed above consists of the fact that the bridge elements may get deformed, before being fractured, in such a way as to enable the ring to rotate integrally with the base body of the cap.

This partially cancels the effect of the opening indicating element, inasmuch as the container can be opened, so that part of the contents can be taken and possibly replaced without the bridge elements break.

As a result, a user is unable to distinguish a whole container from one that has been tampered with.

Caps are furthermore known that are provided with seal elements arranged to enable a hermetic closure of the containers with which they are associated.

A first type of seal elements comprises a disc-shaped seal made of plastic matter, for example an elastomer, fixed to an internal surface of the bottom wall of the cap.

When the cap is tightened on the neck of a container, the disc-shaped seal is pressed against a mouth of the neck to prevent leaks of liquid.

A drawback of the seal elements of the type disclosed above consists of the fact that the contact between the disc-shaped seal and the mouth occurs at a zone—substantially shaped as an annulus—having rather a limited extent.

As a result, the disc-shaped seals disclosed above may not be able to ensure a satisfactory seal.

A second type of seal elements comprises a disc from which a first annular bead and a second annular bead depart, being the first annular bead concentric with the second annular bead, the second annular bead having a diameter that is greater than the first annular bead and therefore being arranged outside the latter.

The first annular bead is configured in such a way as to be received at the inside of a neck of a container in such a way that an external wall of the first annular bead interacts in use with an internal surface of the neck.

The second annular bead is shaped in such a way as to partially surround the neck, such that an internal wall of the second annular bead interacts in use with an external surface of the neck.

The distance between the first annular bead and the second annular bead is substantially the same as or shorter then the thickness of the cylindrical wall that defines the neck.

A drawback of the seal elements of the type disclosed above consists of the fact that the production thereof is difficult because they require precise dimensional tolerances.

Furthermore, the manufacture of such seal elements requires the use of rather complicated moulds.

An object of the invention is to improve the known closure elements.

Another object of the invention is to obtain a closure element that promotes a rapid and effective detachment of an opening indicating element from a body of the cap.

A further object is to obtain a cap provided with an opening indicating element that does not rotate integrally with the body of the cap when the latter is unscrewed from the neck of a container.

A still further object is to obtain seal elements for caps that are simple to make and easy to apply to a neck of a container.

In a first aspect of the invention, a cap is provided, comprising an opening indicating element provided with a flap arrangement suitable for interacting with an abutment arrangement associated with a neck of a container, wherein said flap arrangement comprises at least one first portion and at least one second portion arranged alongside one another along a peripheral edge of said opening indicating element, a dimension of said at least one second portion measured transversely in relation to said peripheral edge being greater then a corresponding dimension of said at least one first portion measured transversely in relation to said peripheral edge.

In un second aspect of the invention, a container is provided, comprising a neck from which an abutment arrangement projects and a cap provided with a flap arrangement suitable for interacting with said abutment arrangement, said abutment arrangement comprising a plurality of distinct abutment elements, wherein said flap arrangement comprises at least one portion suitable for being received in a gap defined by two consecutive abutment elements of said plurality of abutment elements.

The cap comprises a flap arrangement provided with at least one first portion arranged to interact with a zone of the abutment elements and at least one second portion arranged to interact with a further zone of the abutment elements.

The first zone and the second zone define active surfaces of the abutment elements mutually tilted.

In particular, one of the active surfaces is arranged transversely to a direction along which the cap is rotated to be separated from the container.

In this way, the surface acts as a stopping surface for the opening indicating element, which cannot be rotated without fracturing bridge elements that connect the opening indicating element to a base body of the cap.

The bridge elements break after the cap has been rotated in relation to the neck by an extremely limited angle.

Owing to these aspects of the invention, it is therefore possible to obtain a cap that cannot be tampered without any tampering being clearly shown by the opening indicating element.

It is furthermore possible to obtain rapid opening of the containers to which the cap is applied inasmuch as the interaction of the at least one first portion and of the at least one second portion of the flap arrangement with the active surfaces of the abutment elements causes an immediate fracture of the bridge elements.

In a third aspect of the invention, there is provided a seal member for a cap associable with a neck of a container, comprising a central zone from which a projection projects that is suitable for interacting with a mouth of said neck, wherein it further comprises a substantially flat annular portion that extends from said projection externally of said central zone.

In a fourth aspect of the invention, there is provided a closure element, comprising a cap associable with a neck of a container and a seal member suitable for being interposed between said cap and said neck, said seal member comprising an annular portion suitable for interacting with a mouth of said neck, wherein said cap is internally provided with a pressing element arranged to interact with said annular portion, when said cap is tightened on said neck.

Owing to these aspects of the invention it is possible to obtain a seal member that associate high sealing efficiency with significant manufacturing simplicity and application to a neck of a container.

In particular, the seal member according to the invention is significantly more effective than the flat disc-shaped seals and is much easier to make and apply than the disc seals provided with a pair of concentric beads.

In fact, during operation, the projection of the seal member is received in a shapingly coupled manner inside the neck in such a way as to interact with an internal surface of the latter.

Furthermore, when the cap inside which the seal member is positioned is tightened on the neck the substantially flat annular portion is deformed so as to interact with an external surface of the neck, partially enveloping it.

It is thus possible to obtain improved sealing inasmuch as the substantially flat annular portion fits itself according to the particular geometry of the space defined between the cap and the neck, thus enabling a satisfactory seal to be obtained even in the case of necks and caps that have actual dimensions that differ from the theoretical ones.

This cannot be obtained with circular seals provided with a pair of concentric beads according to the state of the art.

The invention can be better understood and carried out with reference to the attached drawings, that illustrate some exemplifying and non-limiting embodiments thereof, in which.

Figure 1:
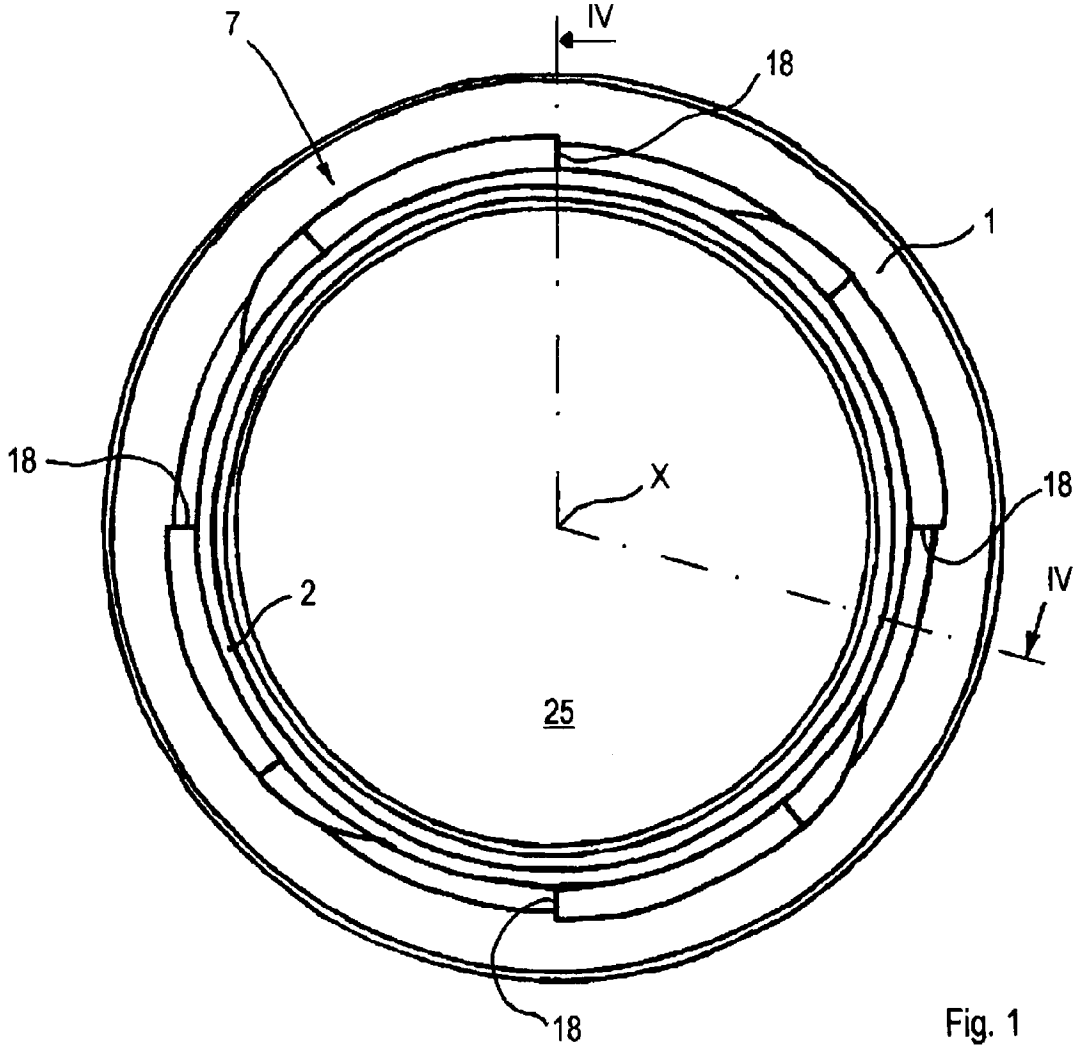
FIG. 1 is a plan view of a neck of a container provided with an abutment arrangement comprising a plurality of distinct abutment elements.

With reference to FIGS. 1 to 8, there is shown a neck 1 of a container comprising a side wall 24 that limits an opening 25 of the container.

On the side wall 24 there is made a thread 2 shaped in such a way as to engage with a corresponding further thread 3 obtained inside a cap 4 that has to be associated with the neck 1.

The cap 4 can be obtained by compression moulding of plastic matter or by other known productive processes.

The neck 1 is equipped with an abutment arrangement 5, projecting circumferentially from the side wall 24, arranged to interact with an opening indicating element 7 with which the cap 4 is provided.

The opening indicating element 7 comprises a ring 8 connected to a base body 9 of the cap 4 by means of bridge elements intended to be fractured at the moment of the first opening of the container.

The base body 9 is defined by a side skirt 26 and by a bottom wall 27.

From an end zone of the ring 8 a flap arrangement 10 projects that in use is arranged inside the cap 4.

At the moment of the first opening of the container, the flap arrangement 10 interacts with the abutment arrangement 7 to promote the breakage of the bridge elements and the consequent detachment of the ring 8 from the base body 9.

The abutment arrangement 5 comprises a plurality of distinct abutment elements 11, the abutment elements 11 being arranged along the external perimeter of the neck 1 in such a way that between two adjacent abutment elements 11 a gap 12 is defined.

Figure 2:
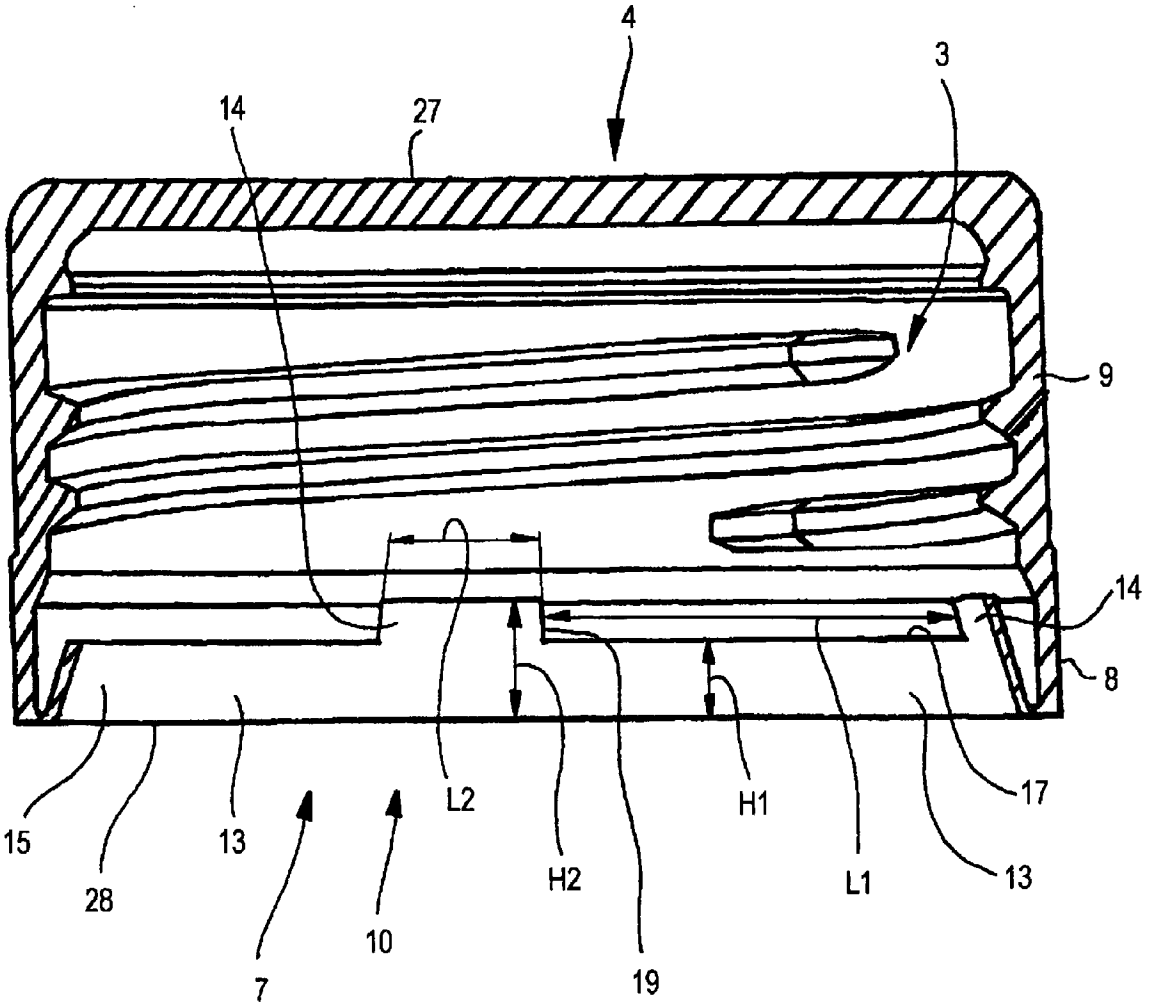
FIG. 2 is an axial section of a cap provided with a flap arrangement.

As shown in FIG. 2, the flap arrangement 10 comprises a continuous flap 15 having an annular shape that is provided with first portions 13, having a preset circumferential extent L1 and a preset height H1 and second portions 14, having a further preset circumferential extent L2 and a further preset height H2 that is greater than the preset height H1.

The first portions 13 and the second portions 14 project from a peripheral edge 28 of the ring 8 farther from the bottom wall 27.

Each first portion 13 is interposed between two second portions 14, in such a way that the first portions 13 and the second portions 14 alternate.

In addition, the preset extent L1 and the further preset extent L2 are selected in such a way that when the cap 4 is associated with the neck 1 the second portions 14 are received in the gaps 12 defined between the abutment elements 11 and therefore each abutment element 11 is received between two consecutive second portions 14 so as to overlap a first portion 13 interposed between them.

The abutment elements 11 comprise a first face 16 arranged to interact with a corresponding first active surface 17 of the first portion 13 and a second face 18 arranged to interact with a corresponding second active surface 19 of the second portion 14.

The first face 16 is substantially parallel to the peripheral edge 28 and is arranged substantially perpendicular to the second face 18.

The first active surface 17 is substantially parallel to a plane defined by the opening 25 and is arranged substantially perpendicular to the second active surface 19.

Figure 6:
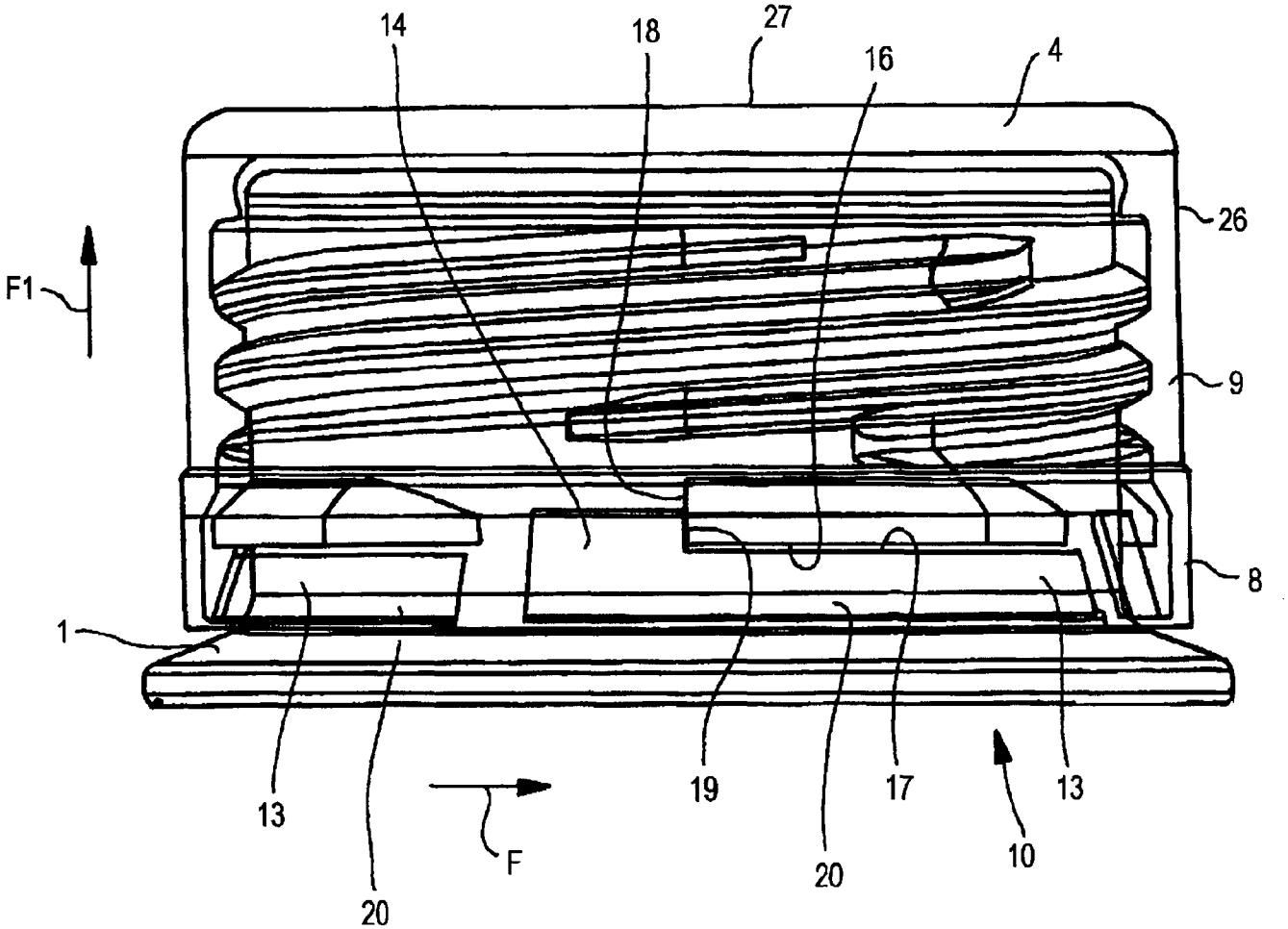
FIG. 6 is a transparent side view of the cap of FIG. 3 associated with the neck in FIG. 5.
Figure 7:
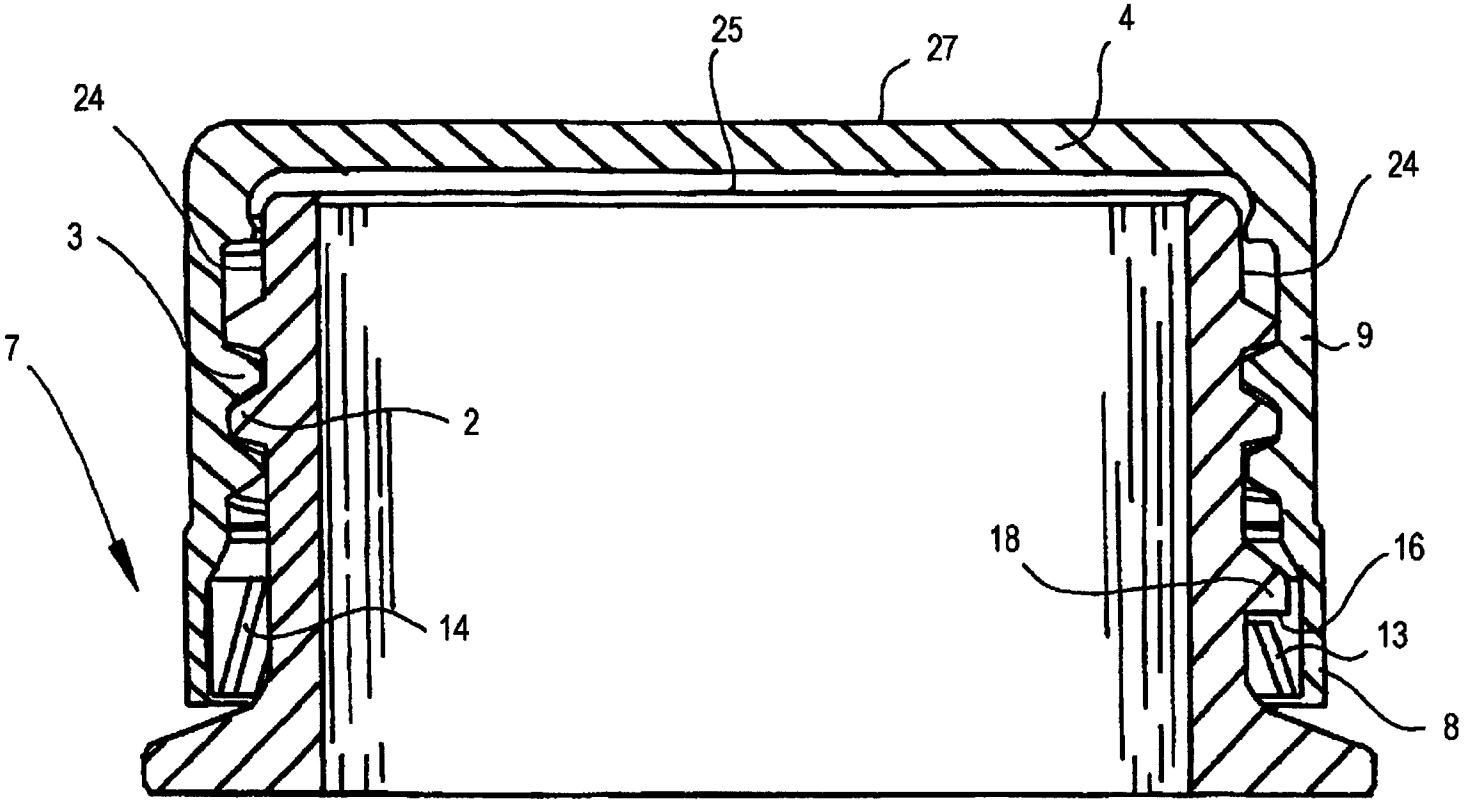
FIG. 7 is a section like the one in FIG. 4 showing the cap of FIG. 2 associated with the neck in FIG. 5.

At the moment of the first opening of the container, the cap 4 is rotated in the direction indicated by the arrow F in FIG. 6.

The mutual interaction of the first thread 2 and of the second thread 3 causes a shift of the cap 4 parallel to a longitudinal axis X of the neck 1, the cap 4 moving away from the container as shown by the arrow F1.

In this way, the base body 9 is induced to move away from the container whereas the ring 8 is kept in contact with the neck 1 by the abutment arrangement 5.

The first active surface 17 is then interacts with the first face 16 generating a tensile stress that promotes the breakage of the bridge elements, similarly to what occurs in caps made according to the state of the art.

In addition, the second active surface 19 is made to interact with the second face 18 so as to prevent rotation of the ring 8 integrally with the base body 9.

The interaction between the second active surface 19 and the second face 18 subjects the bridge elements to shearing stress that causes them to break early.

As a result, the container cannot be tampered with in any way without the bridge elements being fractured, this fracture occurring after an extremely limited angle of rotation of the cap 4 in relation to the neck 1.

Figure 8:
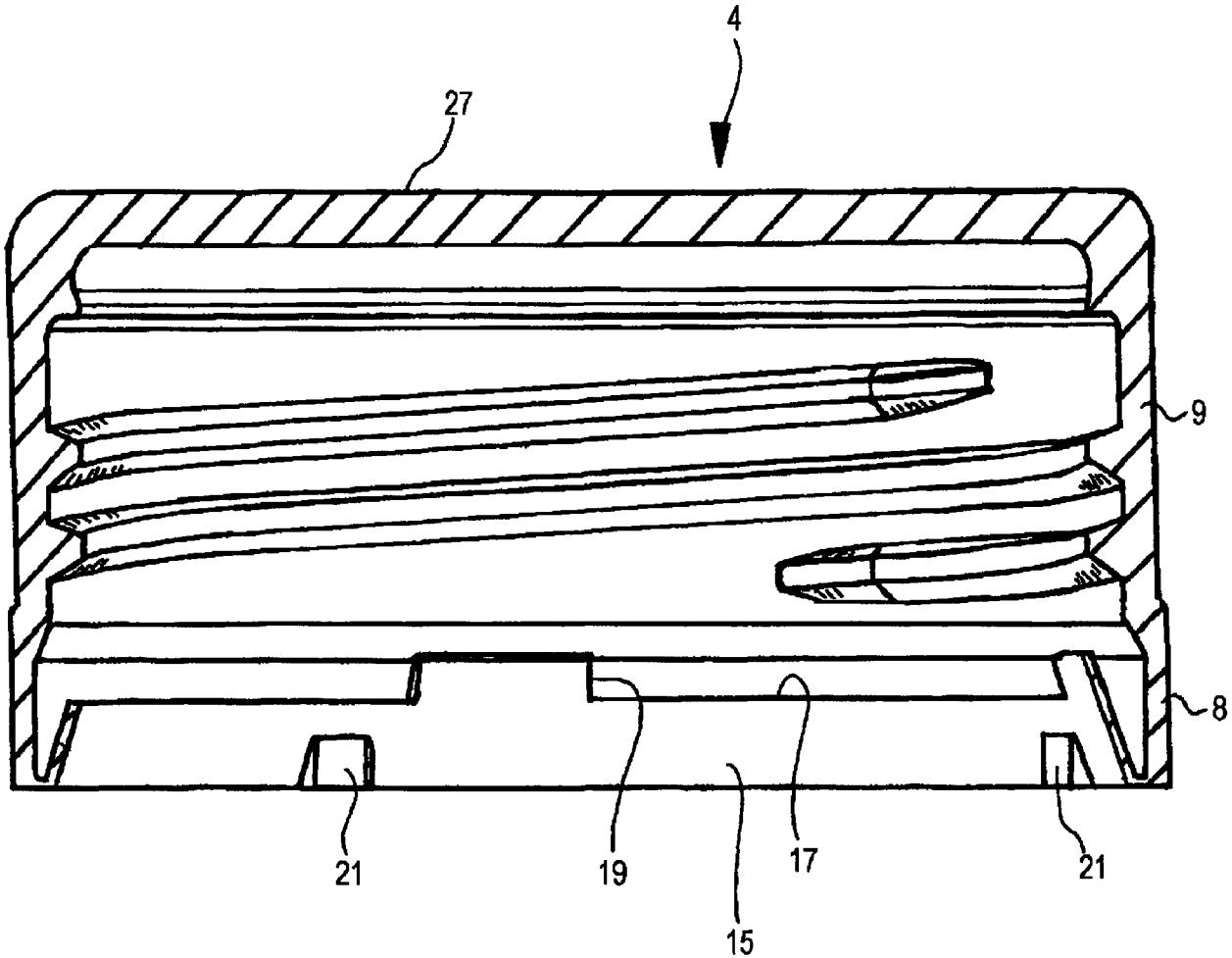
FIG. 8 is a view like the one in FIG. 2 showing a further version of the cap comprising a flap arrangement provided with holes.

With reference to FIG. 8, there is shown a version of the opening indicating element 7 comprising a continuous flap 15 in which a plurality of holes 21 is made that enables the escape of liquid that during the bottling operations was retained in a zone of the opening indicating element 7 near the peripheral edge 28 and delimited by the flap 15, by a bottom zone of the ring 8 and by a deformable portion of material with which the cap 4 is made and which defines a hinge that interconnects the flap 15 to the ring 8.

Owing to the holes 21, undesired accumulations of liquid are substantially prevented so as to noticeably improve the hygiene of the container.

The holes 21, furthermore, by increasing the deformability of the ring 8, make the application of the latter easier, inasmuch as they facilitate outward expansion of the flap 15 when the ring 8 is induced to go beyond the abutment arrangement 5.

Figure 3:
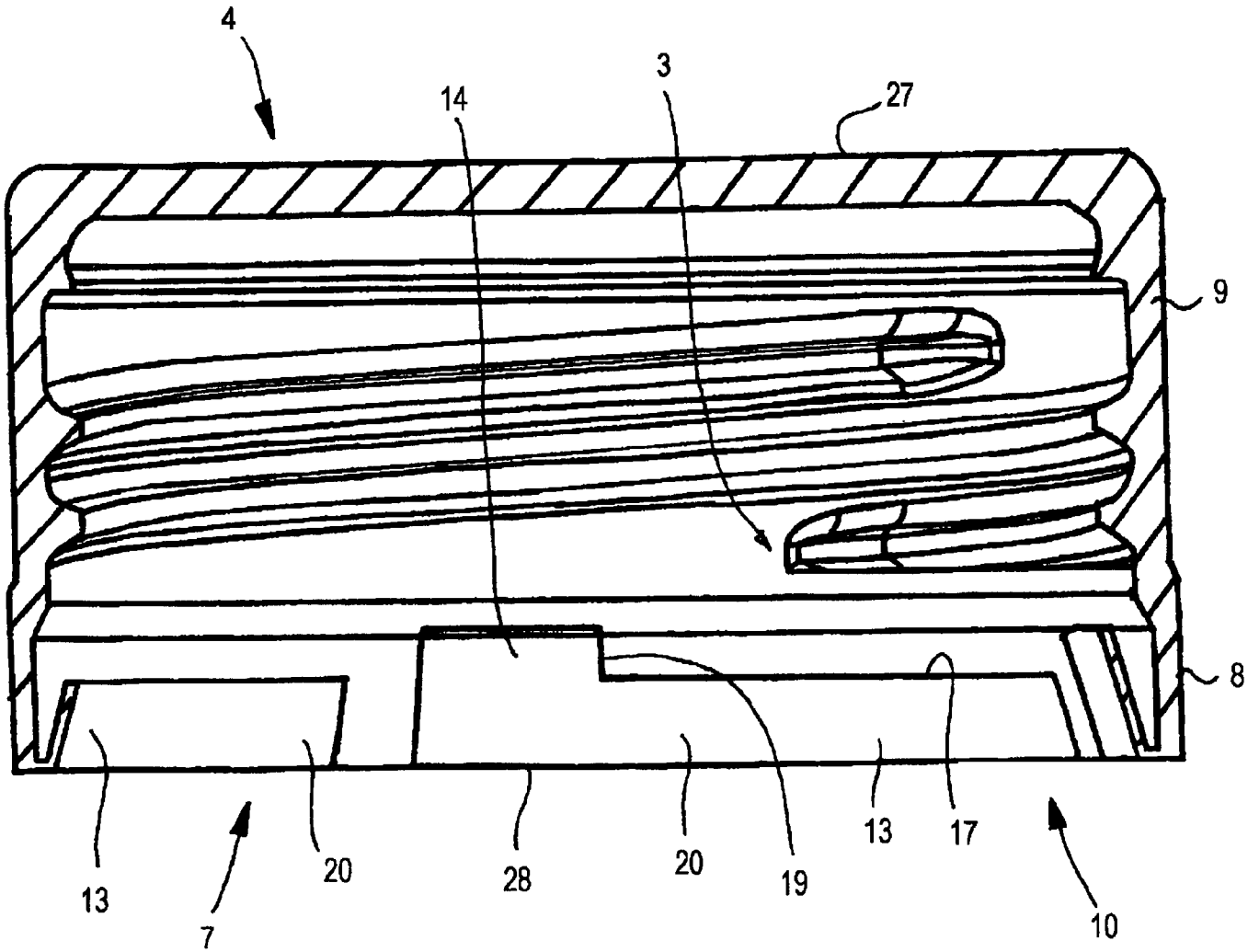
FIG. 3 is a view like the one in FIG. 2, showing a flap arrangement made according to a version.
Figure 4:
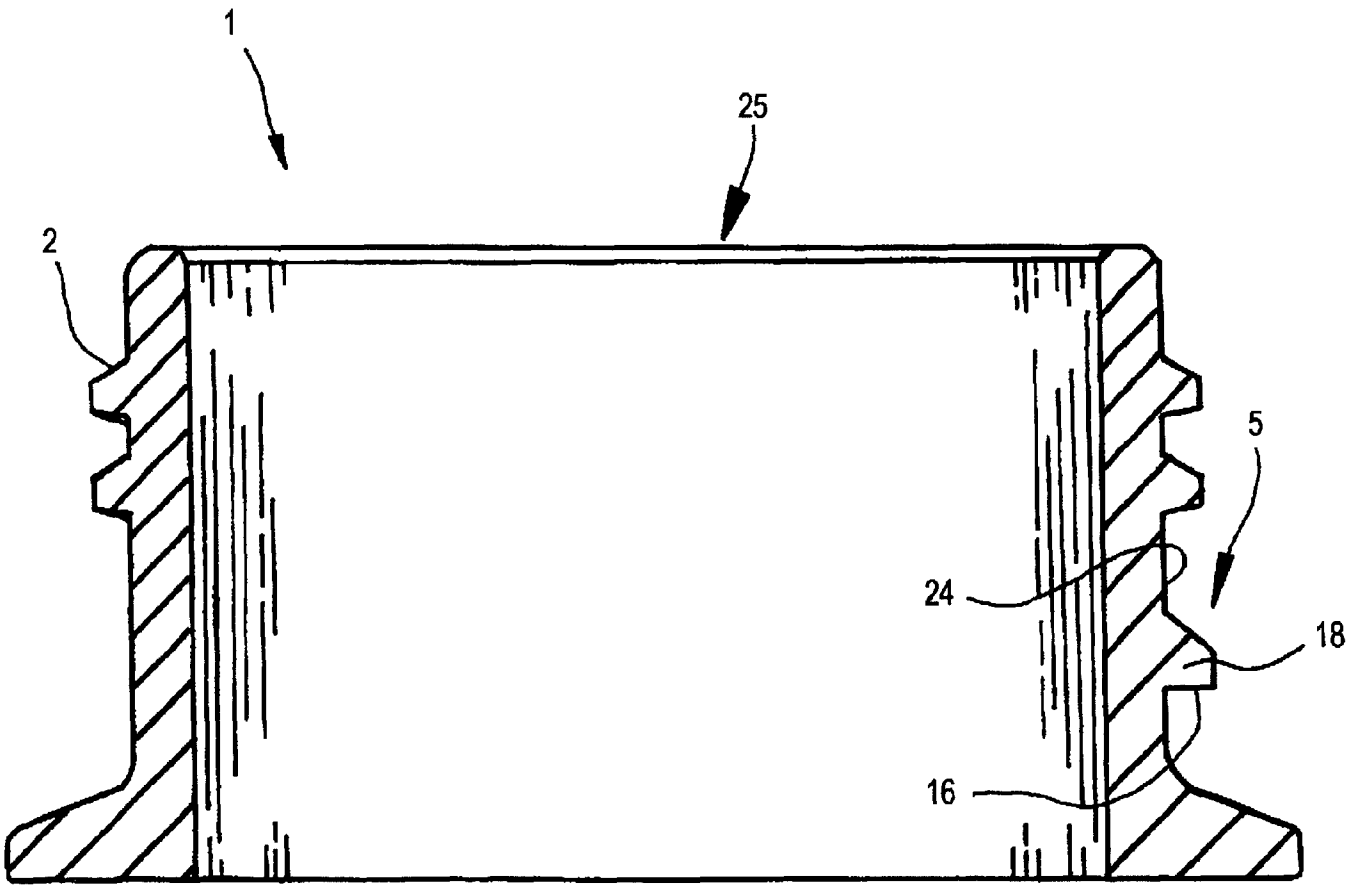
FIG. 4 is a section IV-IV of FIG. 1.
Figure 5:
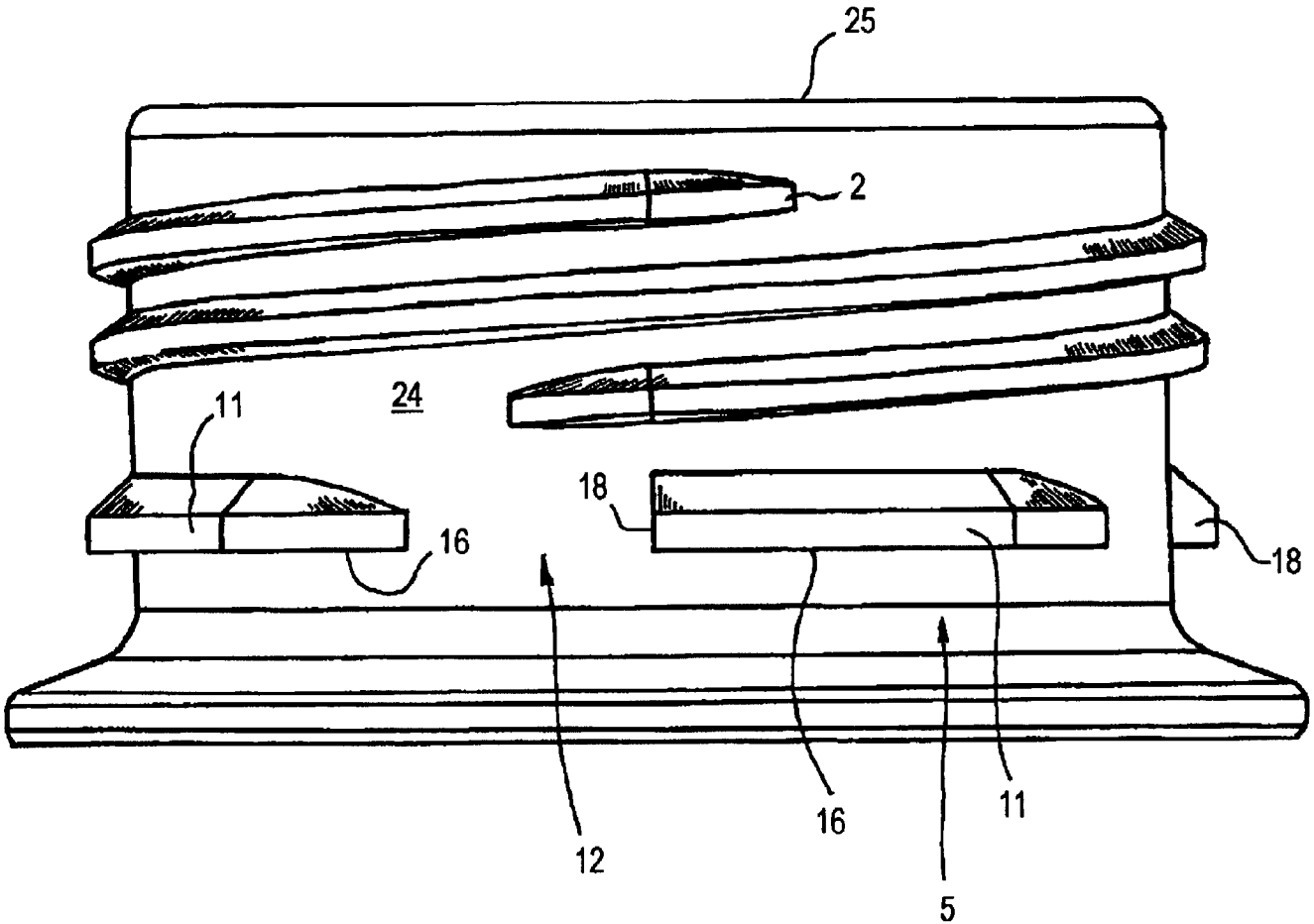
FIG. 5 is a side view of the neck in FIG. 1.

With reference to FIGS. 3 and 6, there is shown an embodiment of the cap 4 in which the flap arrangement 10 comprises a plurality of flaps 20 that are separate from one another rather than a continuous flap 15.

Each flap 20 comprises a first portion 13 and a second portion 14, configured according to what is disclosed with reference to FIG. 2.

Figure 9:
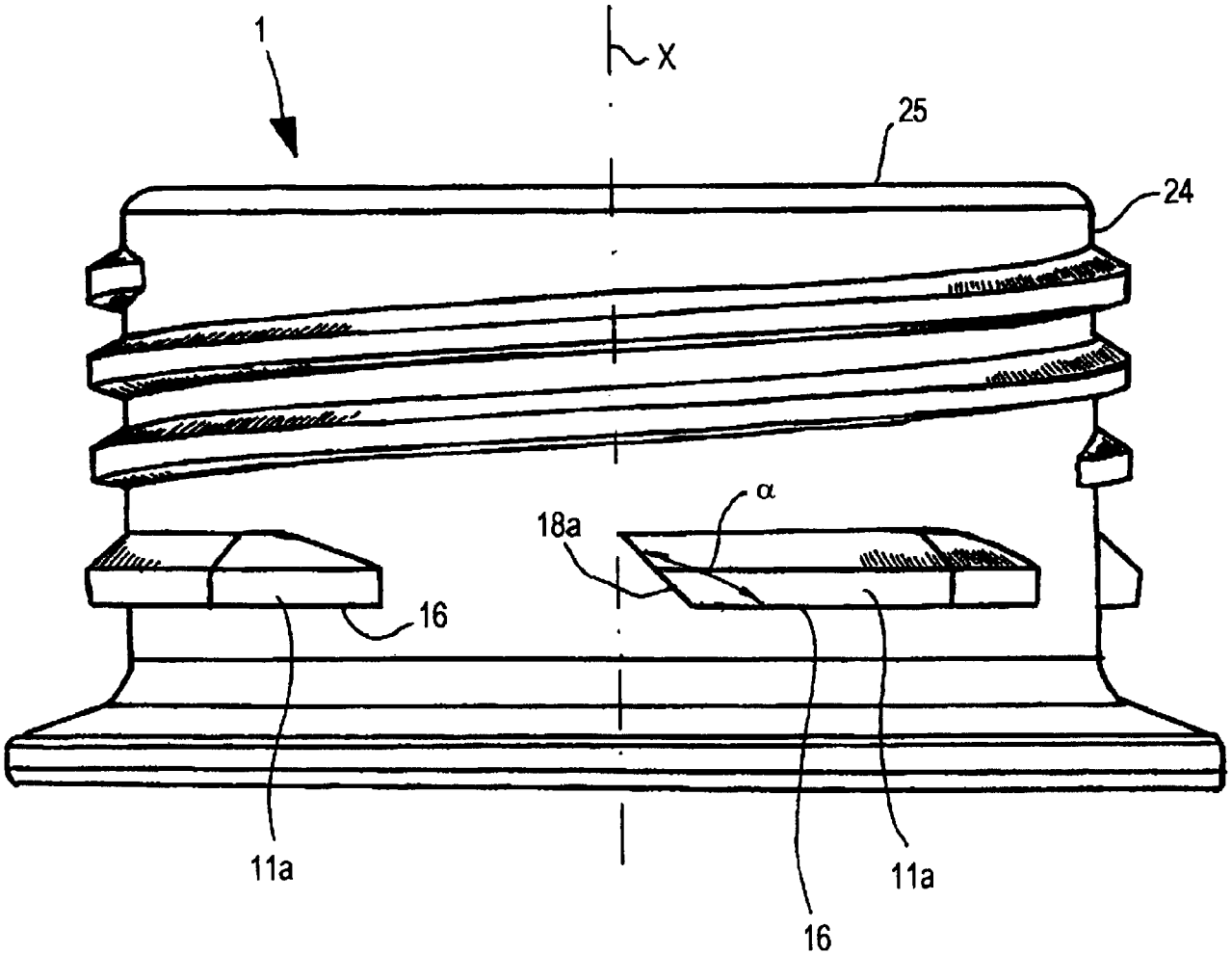
FIG. 9 is a view like the one in FIG. 5, showing a neck provided with an abutment arrangement made according to an embodiment.

In FIG. 9, there is shown an embodiment of the neck 1 comprising further abutment elements 11*a* provided with a first face 16 that is substantially parallel to a plane identified by the opening 25, similar to what is disclosed with reference to FIGS. 1 to 8.

The further abutment elements 11*a* furthermore comprises a further second face 18*a* that forms an obtuse dihedral angle $\alpha$ with the first face 16.

Figure 10:
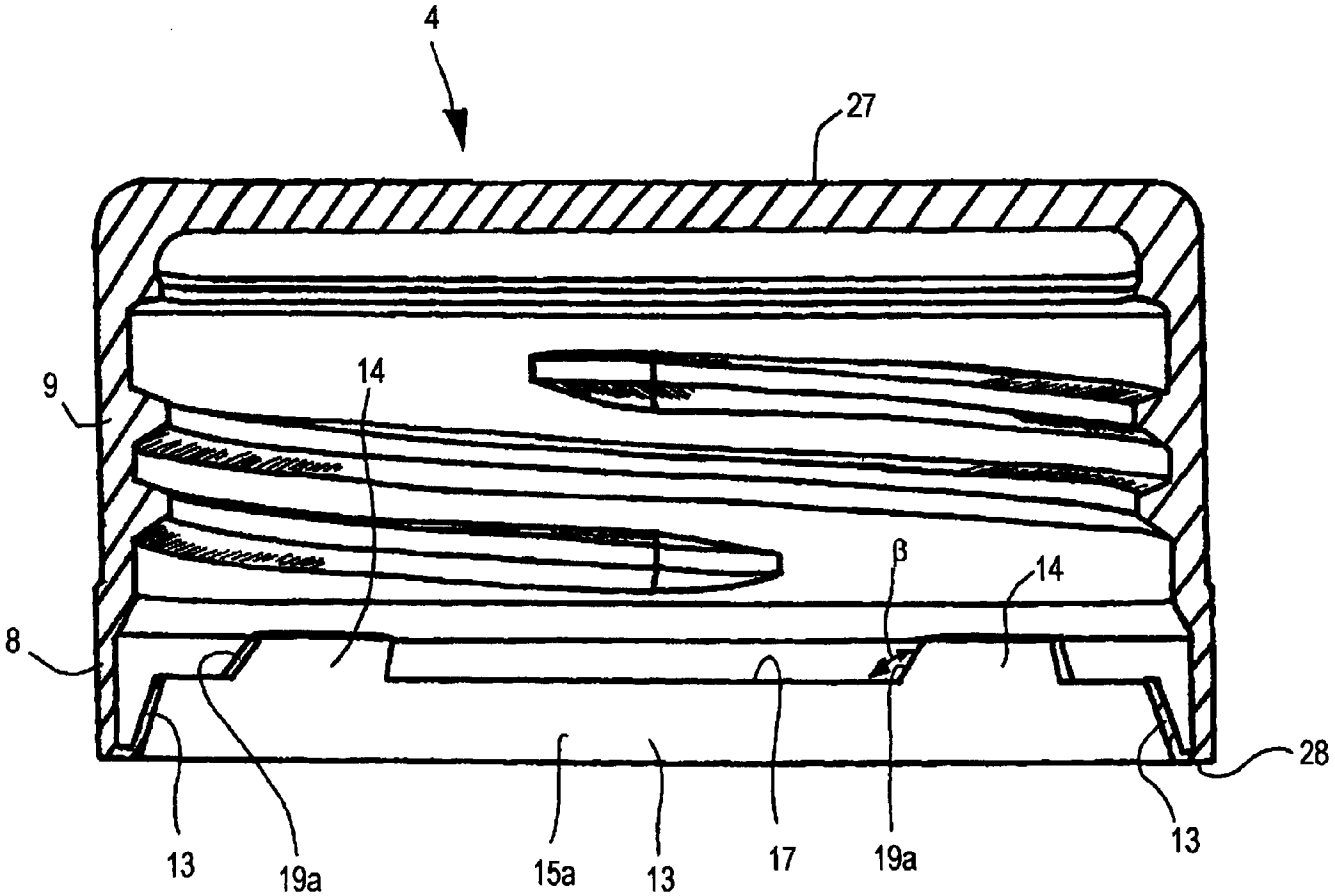
FIG. 10 is an axial section of a cap comprising a flap arrangement made according to another embodiment.

With reference to FIG. 10, there is shown a version of the cap 4 comprising a further continuous flap 15*a* that is provided with first portions 13 each of which is provided with a first surface 17 substantially parallel to the peripheral edge 28.

The further flap 15*a* furthermore comprises second portions 14 each one of which is provided with a further second active surface 19*a* that forms with the first active surface 17 adjacent to it a further obtuse dihedral angle $\beta$ having a degree that is substantially the same as that of the dihedral angle $\alpha$.

The cap 4 may be provided with holes obtained in the further flap 15*a*, similarly to what is disclosed with reference to FIG. 8.

The cap 4 may comprise a plurality of flaps, as disclosed with reference to FIG. 3 rather than a further flap 15*a*.

Figure 11:
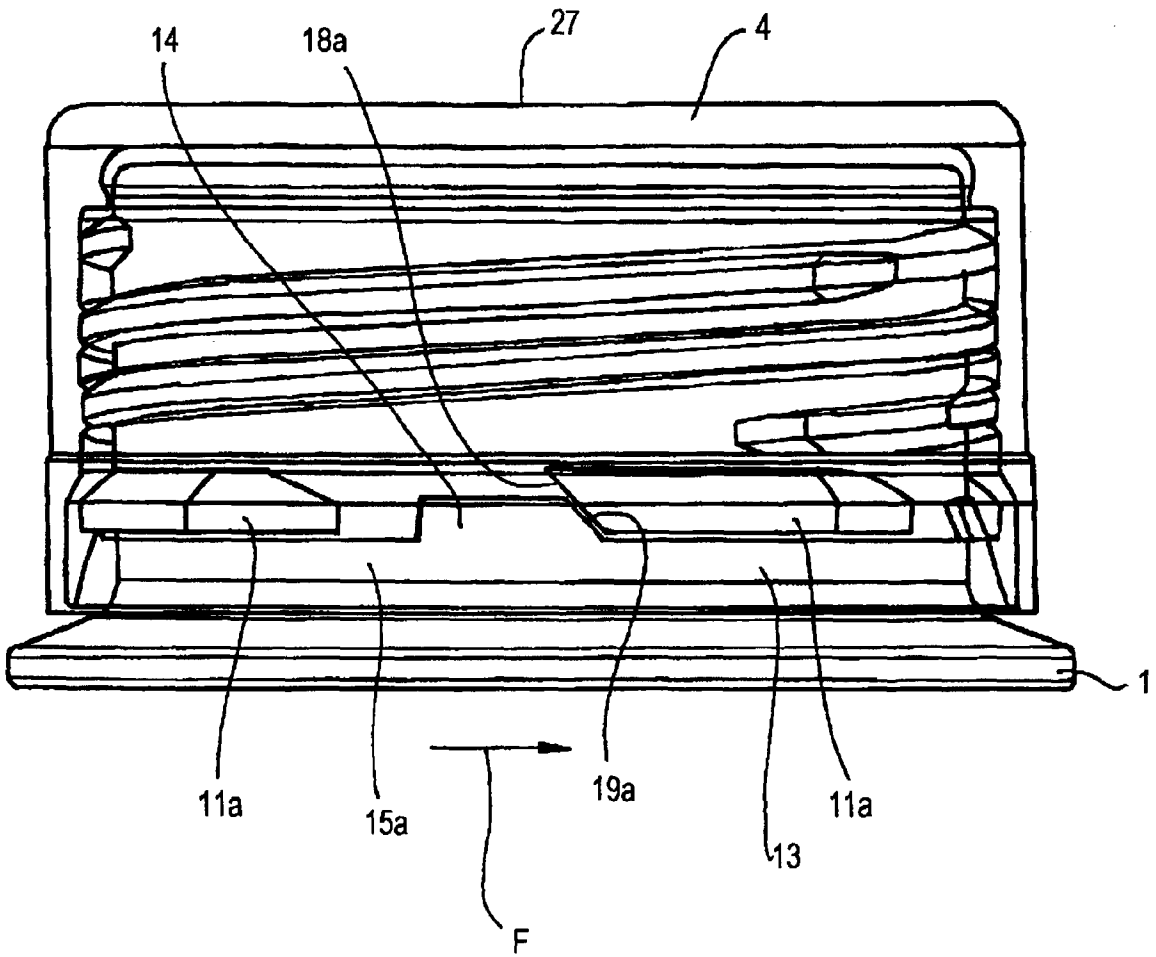
FIG. 11 is a view like the one in FIG. 6, showing the cap of FIG. 10 associated with the neck in FIG. 9.

As shown in FIG. 11, when the cap 4 is associated with the neck 2 each second portion 14 is received in a gap 12 defined between two further consecutive abutment elements 11*a* in such a way that each first active surface 17 faces a corresponding first face 16 and each further second active surface 19*a* faces a corresponding further second face 18*a*.

At the moment of the first opening of the container, a rotation of the cap 4 in relation to the neck 1 induces the further second active surface 19*a* to run on the further second face 18*a*.

As a result the ring 8 moves away from the base body 9, which in turn moves away from the further abutment elements 11*a*.

In other words, when the cap 4 is screwed off the neck 1 the ring 8 and the base body 9 mutually move away from opposite parts of the further abutment elements 11*a*, thus ensuring early breakage of the bridge elements.

Figure 12:
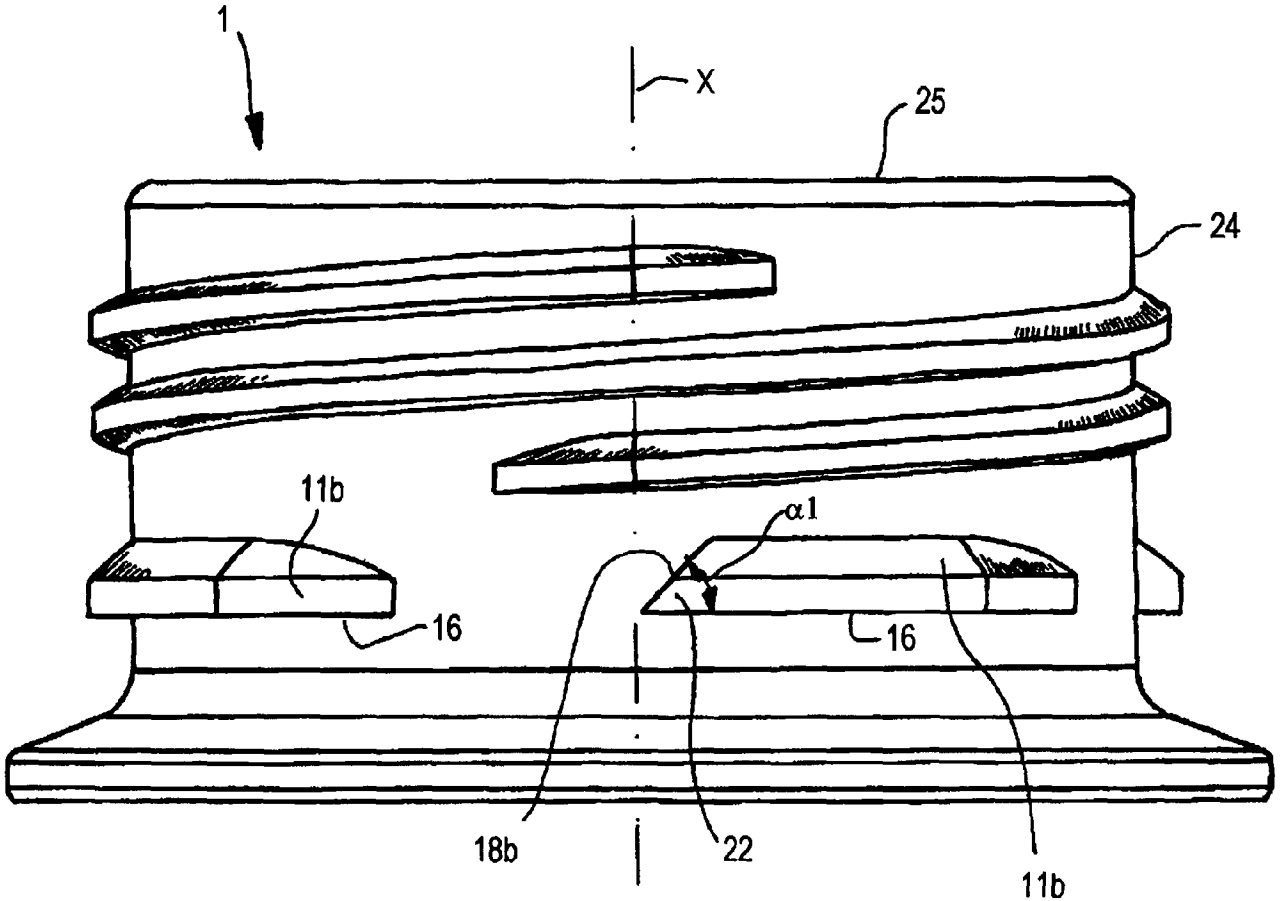
FIG. 12 is a view like the one in FIG. 5, showing a neck provided with an abutment arrangement made according to a further embodiment.

In FIG. 12, there is shown a further embodiment of the neck 1 comprising still further abutment elements 11*b* provided with a first face 16 that is substantially parallel to a plane identified by the opening 25, similar to what was disclosed with reference to FIGS. 1 to 8.

The still further abutment elements 11*b* furthermore comprises a still further second face 18*b* that forms with the first face 16 an acute dihedral angle $\alpha$1, in such a way as to define pointed zones 22 of the still further abutment elements 11*b*.

Figure 13:
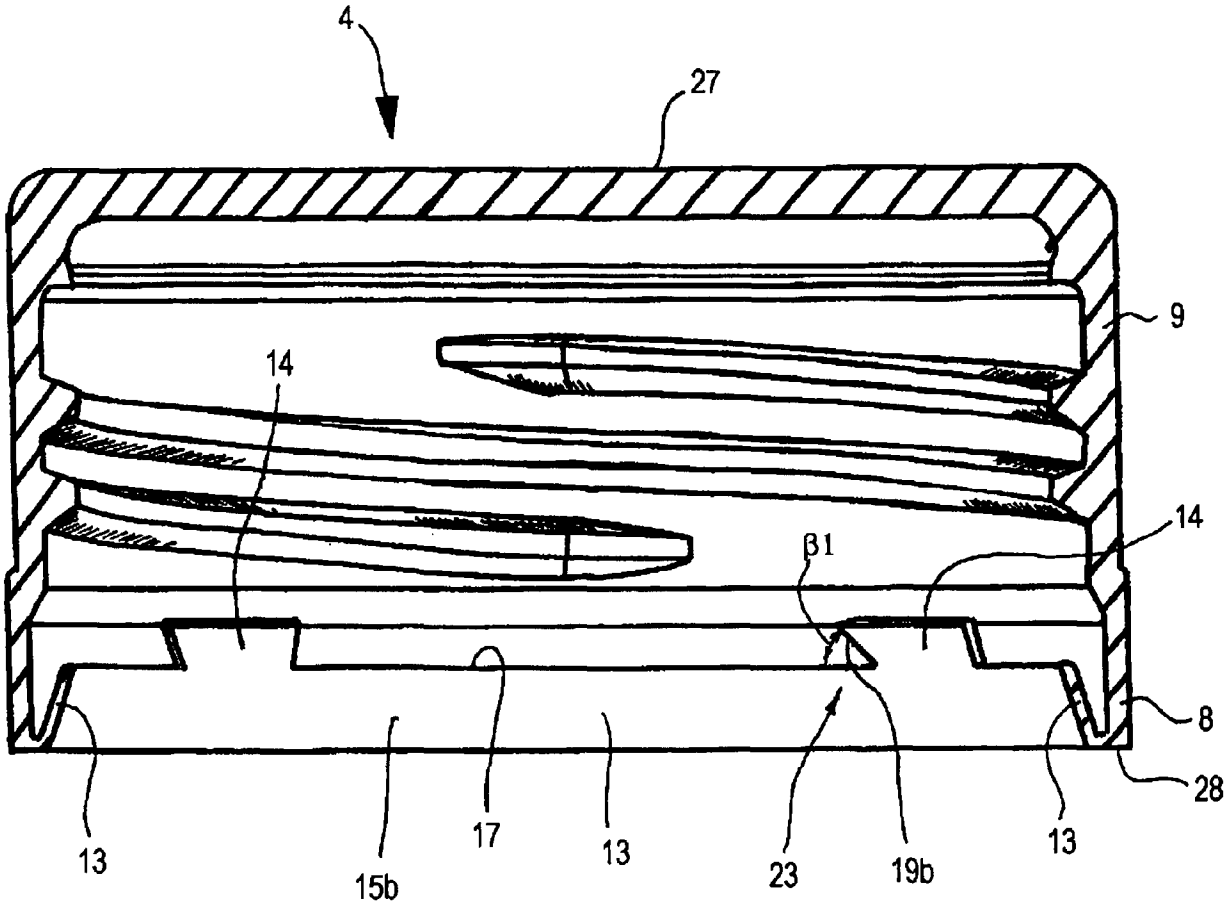
FIG. 13 is an axial section of a cap comprising a flap arrangement made according to a still further embodiment.

With reference to FIG. 13, there is shown a further embodiment of the cap 4 comprising a still further continuous flap 15*b* that is provided with first portions 13, each of which is equipped with a first surface 17 that is substantially parallel to the peripheral edge 28.

The still further flap 15*b* furthermore comprises second portions 14 each one of which is provided with a still further second active surface 19*b* that forms with the first active surface 17 adjacent to it a further acute dihedral angle $\beta$1 having a degree that is substantially the same as that of the dihedral angle $\alpha$1.

The first active surface 17 and the still further second active surface 19*b* define, at a mutual intersecting zone, a throat 23.

The cap 4 can be equipped with holes obtained in the still further flap 15*b*, similarly to what is disclosed with reference to FIG. 8.

The cap 4 may comprise, a plurality of flaps, as disclosed with reference to FIG. 3 instead of a still further continuous flap 15*b*.

Figure 14:
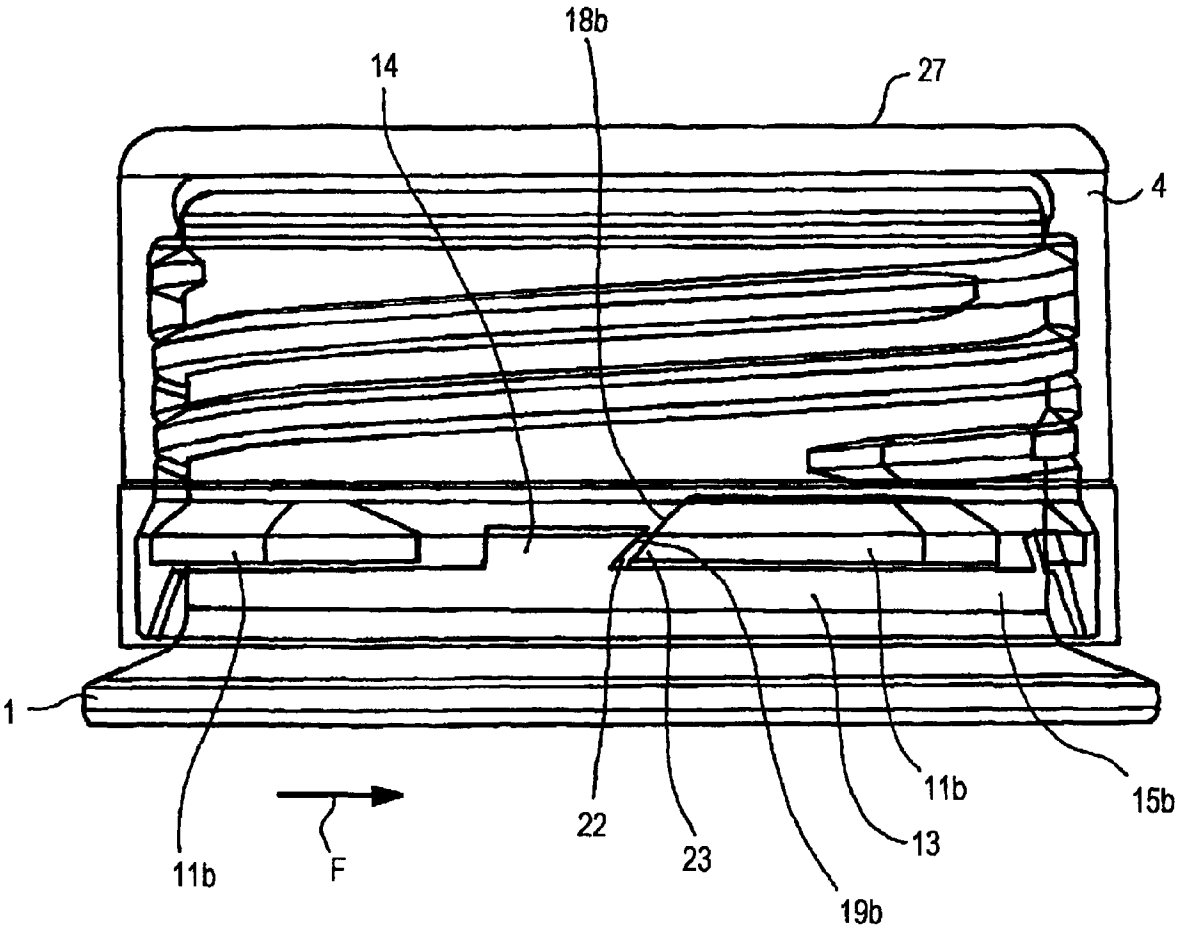
FIG. 14 is a view like the one in FIG. 6, showing the cap of FIG. 13 associated with the neck in FIG. 12.

As shown in FIG. 14, when the cap 4 is associated with the neck 2 each second portion 14 is received in a gap 12 defined between two still further consecutive abutment elements 11*b*, in such a way that each first active surface 17 faces a corresponding first face 16 and each still further second active surface 19*b* faces a corresponding still further second face 18*b*.

At the moment of the first opening of the container, a rotation of the cap 4 in relation to the neck 1 induces the still further second active surface 19*b* to run on the still further second face 18*b*.

In this way, the ring 8 is brought into contact with the still further abutment elements 11*b*, so that each pointed portion 22 is received in a shapingly coupled manner inside a corresponding throat 23.

As a result, the ring 8 cannot rotate integrally with the base body 9, which ensures early breakage of the bridge elements.

It should be noted that even in the cap embodiment shown in FIGS. 10 and 11 and in the further cap embodiment shown in FIGS. 13 and 14, the bridge elements are subjected to tensile stress, generated by the interaction of the first active surface 17 with the first face 16, and to a shearing stress generated by the interaction of the further second active surface 19*a* with the further second face 18*a*, or, respectively, of the still further second active surface 19*b* with the still further face 18*b*.

Figure 15:
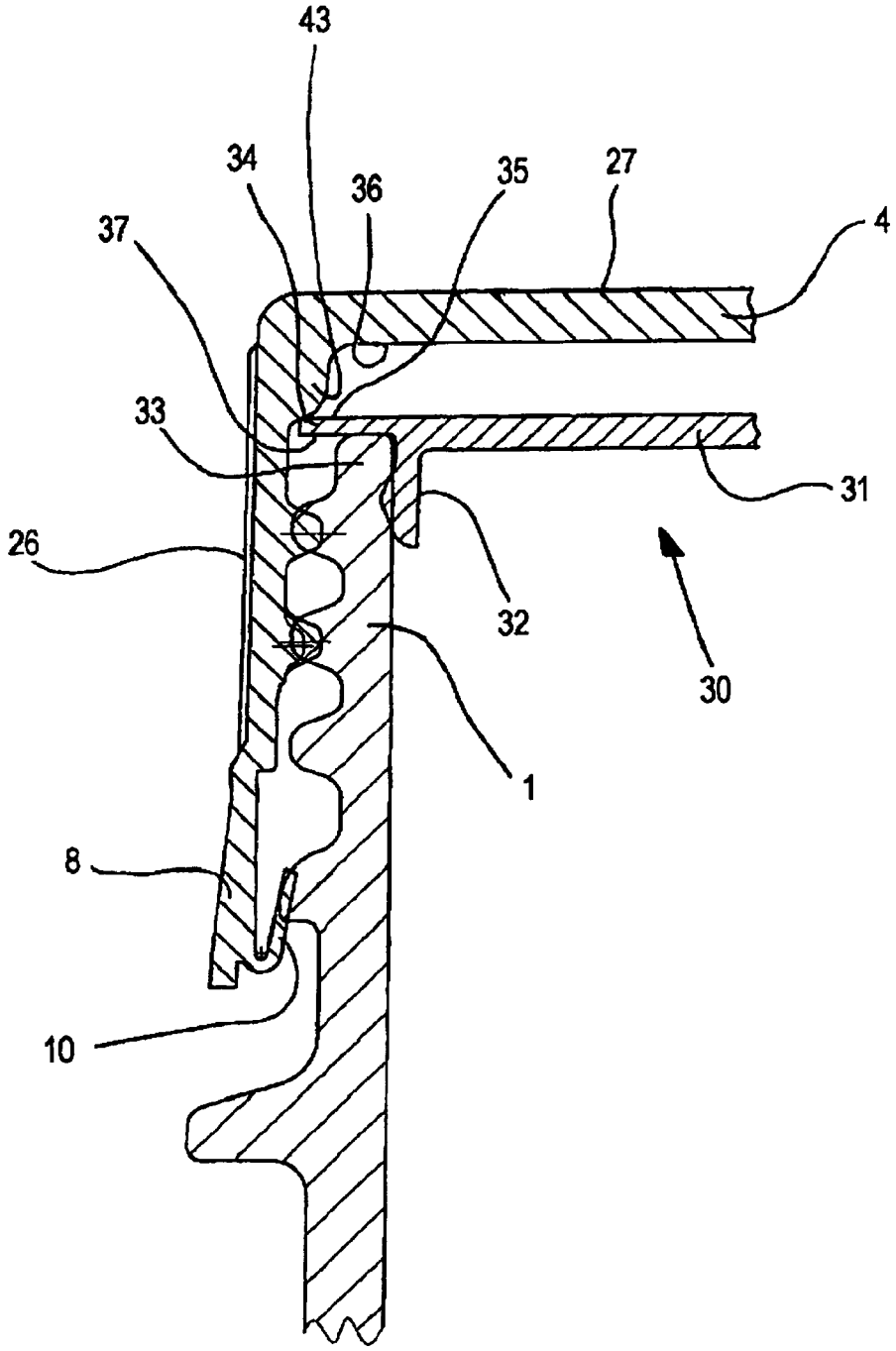
FIG. 15 is a partially fragmentary axial section of a cap and of a seal member distinct from the cap and suitable for cooperating with the cap.
Figure 16:
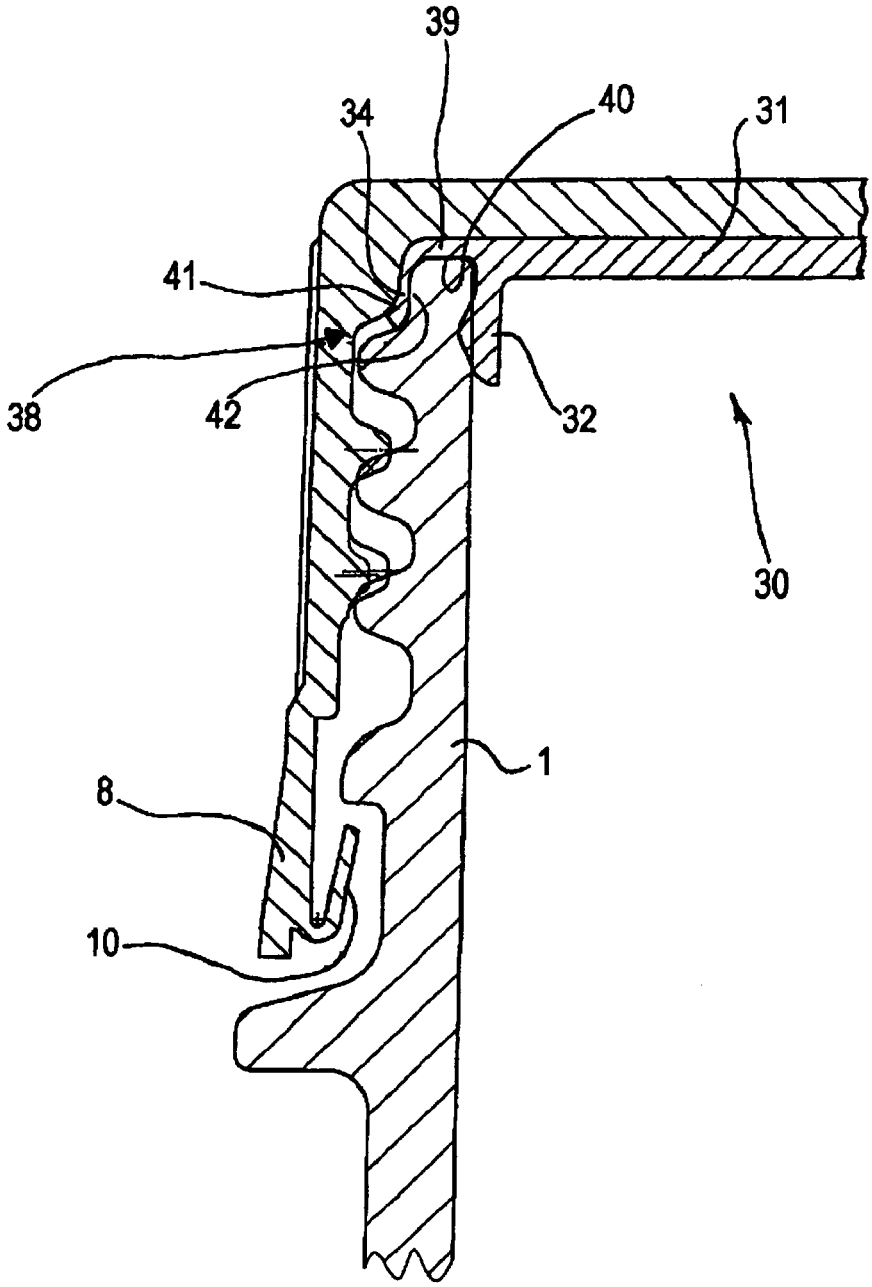
FIG. 16 is a section like the one in FIG. 15 showing the cap completely screwed onto a neck of a container and the seal member tightened between the cap and the neck.

With reference to FIGS. 15 and 16, a seal member 30 is shown arranged to cooperate with a cap 4, for example of the disclosed type, to prevent a product to come out from a container to which the cap 4 is applied.

The seal member 30 comprises a central zone 31—that is disc-shaped—from which a projection 32 projects that is suitable for interacting with a mouth 33 of a neck 1 of the container. The seal member 30 can be made of plastic matter.

The seal member 30 furthermore comprises a substantially flat annular portion 34 that extends from the projection 32 externally of the central zone 31.

The annular portion 34 has a section shaped as an annulus that is provided with a first face 35 arranged to come into contact with the cap 4 and a second face 37 arranged to come into contact with the mouth 33 of the neck 1.

The cap 4 is furthermore provided, at the border zone between the bottom wall 27 and the cylindrical skirt 26, with a shaped edge 43 arranged to interact with the annular portion 34, as will be disclosed in greater detail below.

When the cap 4 is screwed onto the neck 1, the projection 32 is received in a shapingly coupled manner inside the mouth 33. At the same time, the annular portion 34, being tightened between the shaped edge 43 and the mouth 33, is subjected to a certain deformation.

This enables an effective seal action to be obtained inasmuch as the annular portion 34 fits itself in such a way as to substantially completely occupy an interspace 38 defined between the internal surface 36 and the mouth 33.

In particular, a part 39 of the annular portion 34 nearer the projection 32 interacts with an end zone 40 of the mouth 33 that faces the bottom wall 27, whereas a further part 41 of the annular portion 34 farther from the projection 32 interacts with a further end zone 42 of the mouth 33 that faces the side skirt 26.

The mouth 33 is thus internally engaged by the projection 32 and is externally partially enveloped by the annular portion 34.

The annular portion 34, owing to its deformability, fits itself according to the particular geometry of the neck 1, thus enabling an improved seal to be obtained compared with the seals of the state of the art.

The seal member 30 is distinct from the cap 4 and cooperates with the latter when the cap is screwed onto the neck 1.

The container can be sealed according to different operating modes.

According to an operating mode shown in FIGS. 15 and 16, the seal member 30 is positioned on the neck 1 in such a way that the projection 32 is received inside the mouth 31. Subsequently, the cap 4 is positioned on the neck 1 and is screwed onto the latter so as to enclose the seal member 30 within itself.

According to a further operating mode that is not shown, the seal member 30 can be inserted into the cap 4 and can be maintained in the inside of the latter by interference of the annular portion 34 with the thread of the cap. The cap 4 is subsequently screwed onto the neck 1 in such a way that the projection 32 and the annular portion 34 surround the mouth 31.

The invention claimed is:

1. A container comprising a neck and a cap, an abutment arrangement projecting from said neck, said cap comprising a base body and an opening indicating element connected to said base body by means of bridge elements intended to be fractured at the first opening of the container, said opening indicating element being provided with a flap arrangement comprising at least one first portion and at least one second portion arranged alongside one another along a peripheral edge of said opening indicating element, said at least one first portion comprising a first active surface suitable for interacting with a first face of said abutment arrangement generating a tensile stress that promotes the breakage of said bridge elements when said cap is removed from said neck, said at least one second portion comprising a second active surface suitable for interacting with a second face of said abutment arrangement so as to prevent rotation of said opening indicating element integrally with said base body, said interaction between said second active surface and said second face subjecting said bridge elements to a shearing stress that promotes the breakage of said bridge elements when said cap is removed from said neck.

2. The container of claim 1, wherein said abutment arrangement comprises a plurality of distinct abutment elements, said at least one second portion being received in a gap defined between two consecutive abutment elements of said plurality of abutment elements.

3. The container of claim 2, wherein each abutment element of said plurality of abutment elements comprises a second abutment face configured in such a way as to interact with said second active surface of said flap arrangement generating said shearing stress.

4. The container of claim 3, wherein said second abutment face is tilted in relation to a plane defined by an opening of said container.

5. The container of claim 2, wherein each abutment element of said plurality of abutment elements comprises a first abutment face configured in such a way as to interact with said first active surface of said flap arrangement generating said tensile stress.

6. The container of claim 5, wherein said first abutment face is arranged substantially parallel to a plane defined by an opening of said container.

7. The container of claim 1, wherein a dimension of said at least one second portion measured transversely in relation to said peripheral edge being greater than a corresponding dimension of said at least one first portion measured transversely in relation to said peripheral edge.

8. The container of claim 1, wherein said first active surface is arranged substantially parallel to said peripheral edge.

9. The container of claim 1, wherein said second active surface is tilted in relation to said peripheral edge.

10. The container of claim 1, wherein said second face is tilted in relation to a plane defined by an opening of said container.

11. The container of claim 1, wherein said second active surface is obtained on a side of said at least one second portion.

12. The container of claim 1, wherein said first face is arranged substantially parallel to a plane defined by an opening of said container.

13. The container of claim 1, wherein between said first face and said second face a substantially right dihedral angle is defined.

14. The container of claim 1, wherein between said first face and said second face an obtuse dihedral angle is defined.

15. The container of claim 1, wherein between said first face and said second face an acute dihedral angle is defined.

16. The container of claim 1, wherein said flap arrangement comprises a continuous flap having an annular shape.

17. The container of claim 1, wherein said flap arrangement comprises pluralities of distinct flaps.

18. A seal member for a cap associable with a neck of a container, said seal member comprising a disc-shaped central zone, a projection that projects from said central zone, and a substantially flat annular portion that extends from said projection externally of said central zone, said projection being suitable for being received in a shapingly coupled manner inside a mouth of said neck when said cap is tightened on said neck, said annular portion comprising a first part suitable for interacting with an end zone of said mouth that faces a bottom wall of said cap, said annular portion comprising a second part farther from said projection than said first part and suitable for interacting with a further end zone of said mouth that faces a side skirt of said cap, said first part and second part of said annular portion being thinner than said central zone, said first part and second part of said annular portion being coplanar with said central zone.

19. The seal member of claim 18, wherein said annular portion is made of easily deformable material.

20. The seal member of claim 18, wherein said projection is arranged substantially perpendicular to said annular portion.

21. A closure element comprising a cap and a seal member, said cap being associable with a neck of a container, said seal member being suitable for being interposed between said cap and said neck, said cap comprising a skirt portion and a bottom portion, said seal member comprising an annular portion suitable for interacting with a mouth of said neck, a first part of said annular portion being suitable for interacting with an end zone of said mouth that faces said bottom portion, a second part of said annular portion being suitable for interacting with a further end zone of said mouth that faces said skirt portion, said cap being internally provided with a pressing element arranged to interact with said second part of said annular portion when said cap is tightened on said neck, said pressing element comprising a shaped edge at a border zone between said skirt portion and said bottom portion, said second part of said annular portion being tightened between said shaped edge and said mouth when said cap is tightened on said neck, said second part of said annular portion being made of deformable material such as to substantially completely occupy a space defined between an internal surface of said shaped edge and said further end zone of said mouth when said cap is tightened on said neck, said space having a first zone nearer said bottom portion of said cap and a second zone farther from said bottom portion whereby said first zone has a width not greater than a width of said second zone, said seal member comprising a disc-shaped central zone and a projection that projects from said central zone, said projection being suitable for being received in a shapingly coupled manner inside a mouth of said neck when said cap is tightened on said neck, said annular portion extending from said projection externally of said central zone.

22. The closure element of claim 21, wherein said first part and second part of said annular portion are thinner than said central zone.

23. The closure element of claim 21, wherein said first part and second part of said annular portion are coplanar with said central zone.

24. The closure element of claim 21, wherein said projection is arranged substantially perpendicular to said annular portion.

25. The closure element of claim 21, wherein said cap comprises an opening indicating element provided with a flap arrangement suitable for interacting with an abutment arrangement associated with said neck, said flap arrangement comprising at least one first portion and at least one second portion arranged alongside one another along a peripheral edge of said opening indicating element, a dimension of said at least one second portion measured transversely in relation to said peripheral edge being greater then a corresponding dimension of said at least one first portion measured transversely in relation to said peripheral edge.

26. The closure element of claim 25, wherein said at least one second portion comprises an active surface tilted in relation to said peripheral edge and configured in such a way as to interact with a face of said abutment arrangement, said active surface being obtained on a side of said at least one second portion projecting from said peripheral edge.

27. The closure element of claim 26, wherein said at least one first portion comprises a further active surface configured in such a way as to interact with a further face of said abutment arrangement, said further active surface being arranged substantially parallel to said peripheral edge.

28. The closure element of claim 25, wherein said flap arrangement comprises a continuous flap having an annular shape.

29. The closure element of claim 25, wherein said flap arrangement comprises pluralities of distinct flaps.

30. A cap for a container, the cap comprising a base body and an opening indicating element connected to said base body by means of bridge elements intended to be fractured at the first opening of the container, said opening indicating element being provided with a flap arrangement suitable for interacting with an abutment arrangement associated with a neck of said container, said flap arrangement comprising at least one first portion and at least one second portion arranged alongside one another along a peripheral edge of said opening indicating element, a dimension of said at least one second portion measured transversely in relation to said peripheral edge being greater than a corresponding dimension of said at least one first portion measured transversely in relation to said peripheral edge, said at least one first portion comprising a first active surface configured in such a way as to interact with a first face of said abutment arrangement generating a tensile stress that promotes the breakage of said bridge elements when said cap is removed from said neck, said at least one second portion comprising a second active surface configured in such a way as to interact with a second face of said abutment arrangement so as to prevent rotation of said opening indicating element integrally with said base body, said interaction between said second active surface and said second face subjecting said bridge elements to a shearing stress that promotes the breakage of said bridge elements when said cap is removed from said neck, said flap arrangement comprising a continuous flap having an annular shape.

31. A closure element comprising a cap and a seal member, said cap being associable with a neck of a container, said seal member being suitable for being interposed between said cap and said neck, said cap comprising a skirt portion and a bottom portion, said seal member comprising an annular portion suitable for interacting with a mouth of said neck, a first part of said annular portion being suitable for interacting with an end zone of said mouth that faces said bottom portion, a second part of said annular portion being suitable for interacting with a further end zone of said mouth that faces said skirt portion, said cap being internally provided with a pressing element arranged to interact with said second part of said annular portion when said cap is tightened on said neck, said pressing element comprising a shaped edge at a border zone between said skirt portion and said bottom portion, said second part of said annular portion being tightened between said shaped edge and said mouth when said cap is tightened on said neck, said second part of said annular portion being made of deformable material such as to substantially completely occupy a space defined between an internal surface of said shaped edge and said further end zone of said mouth when said cap is tightened on said neck, said space having a first zone nearer said bottom portion of said cap and a second zone farther from said bottom portion whereby said first zone has a width not greater than a width of said second zone, said cap comprising an opening indicating element provided with a flap arrangement suitable for interacting with an abutment arrangement associated with said neck, said flap arrangement comprising at least one first portion and at least one second portion arranged alongside one another along a peripheral edge of said opening indicating element, a dimension of said at least one second portion measured transversely in relation to said peripheral edge being greater then a corresponding dimension of said at least one first portion measured transversely in relation to said peripheral edge, said flap arrangement comprising a continuous flap having an annular shape.

32. A cap for a container, the cap comprising a base body and an opening indicating element connected to said base body by means of bridge elements intended to be fractured at the first opening of the container, said opening indicating element being provided with a flap arrangement suitable for interacting with an abutment arrangement associated with a neck of said container, said flap arrangement comprising a continuous flap, said continuous flap comprising at least one first flap portion and at least one second flap portion arranged alongside one another along a peripheral edge of said opening indicating element, a dimension of said at least one second flap portion measured transversely in relation to said peripheral edge being greater than a corresponding dimension of said at least one first flap portion measured transversely in relation to said peripheral edge, wherein said at least one first flap portion comprises a first active surface configured in such a way as to interact with a first face of said abutment arrangement generating a tensile stress that promotes the breakage of said bridge elements when said cap is removed from said neck, and wherein said at least one second flap portion comprises a second active surface configured in such a way as to interact with a second face of said abutment arrangement so as to prevent rotation of said opening indicating element integrally with said base body, said interaction between said second active surface and said second face subjecting said bridge elements to a shearing stress that promotes the breakage of said bridge elements when said cap is removed from said neck.

33. The cap of claim 32, wherein said continuous flap has an annular shape.

34. The cap of claim 32, wherein said second active surface is tilted in relation to said peripheral edge.

35. The cap of claim 32, wherein said second active surface is obtained on a side of said at least one second flap portion projecting from said peripheral edge.

36. The cap of claim 32, wherein said first active surface is arranged substantially parallel to said peripheral edge.

37. The cap of claim 32, wherein a substantially right dihedral angle is defined between said first active surface and said second active surface.

38. The cap of claim 32, wherein an obtuse dihedral angle is defined between said first active surface and said second active surface.

39. The cap of claim 32, wherein an acute dihedral angle is defined between said first active surface and said second active surface.

* * * * *